United States Patent [19]

Marston et al.

[11] Patent Number: 4,686,710

[45] Date of Patent: Aug. 18, 1987

[54] SPORTS NECK PROTECTOR

[76] Inventors: Stephen Marston, 6980 Cote St.Luc Rd., Apt. 502, Montreal, Quebec, Canada, H4V 3A4; Isaac Aboud, 25 Brittany, Town of Mount Royal, Quebec, Canada, H3P 1A2

[21] Appl. No.: 906,036

[22] Filed: Sep. 11, 1986

[30] Foreign Application Priority Data

Dec. 17, 1985 [CA] Canada ..... 497816

[51] Int. Cl.[4] ..... A41D 13/00

[52] U.S. Cl. ..... 2/2

[58] Field of Search ..... 2/2, 9, 2.1, 46; 128/380

[56] References Cited

U.S. PATENT DOCUMENTS

| | | | |
|---|---|---|---|
| 1,250,150 | 12/1917 | Du Bois | 2/2 |
| 1,648,970 | 11/1927 | Strelow | 2/2 |
| 2,864,091 | 12/1958 | Schneider | 2/161 |
| 3,087,699 | 4/1963 | Foster | 245/2 |
| 3,883,898 | 5/1975 | Byrnes | 2/167 |
| 3,921,222 | 11/1975 | Hollman | 2/2 |
| 4,004,295 | 1/1977 | Byrnes | 2/161 R |
| 4,324,003 | 4/1982 | Johnston | 2/2 |
| 4,333,179 | 6/1982 | Laurita | 2/2 |
| 4,449,251 | 5/1984 | Gauthier | 2/2 |

*Primary Examiner*—Doris L. Troutman

*Attorney, Agent, or Firm*—Samuel Meerkreebs

[57] ABSTRACT

A lightweight, flexible sports neck protector is provided for sports players, especially hockey players, comprising an elongated, substantially flat armour member adapted to be positioned about the neck of a wearer and shaped to at least cover vital areas of the wearer's throat, the armour member being made of a flexible slash-resistant material having a slash-resistance of at least about 120 lbs, and means fixed to the armour member for enabling the member to retain a protective shape over the vital throat areas. The neck protector according to the invention is highly efficient in protecting the vital throat areas against lacerations caused by a sharp-edged object, such as a hockey stick blade or a skate blade, while being sufficiently flexible to permit free movement of the head.

12 Claims, 6 Drawing Figures

SPORTS NECK PROTECTOR

BACKGROUND OF THE INVENTION

The present invention relates to a sports neck protector and, more particularly, to a neck protector for protecting a wearer's throat area against lacerations such as caused by a skate blade of a hockey player.

In contact sports such as hockey, fatal accidents do occur as a result of a player trying to avoid colliding with another player who has fallen on the ice and accidentally severing the carotid artery or jugular vein of the latter's throat with his skate as he skips thereover. The constantly moving hockey stick blade of a player as well as flying pucks which may achieve velocities in excess of 90 m.p.h. may also cause fatal injuries to the throat.

Various neck protectors have already been proposed with a view to protecting the vital throat areas of sports players, for instance in U.S. Pat. Nos. 4,324,003, 4,333,179 and 4,449,251. The throat guard described in U.S. Pat. No. 4,324,003 is composed of U-shaped bands of semi-rigid flat material, such as leather or semi-rigid plastic, that are arranged in overlapping relationship and are free to move relative to one another so as to form a movable expanse which co-acts with the head between chin and chest to continually provide a protective covering for the neck. Although such a throat guard may provide some protection against potentially dangerous blows to the throat from playing sticks, balls or pucks, it is totally inadequate in respect to protecting against throat lacerations since the sharp-edged blade of a skate may cut through a leather band and/or pass between two overlapping bands to injure the player.

The protective neck collar of U.S. Pat. No. 4,333,179, on the other hand, includes an air-inflated padding which upon its front side is shielded by a metal grill. Such a neck collar is not only very uncomfortable to wear but also cumbersome due to the rigidity and bulkiness of the front metal grill. Moreover, it offers no protection of the carotid artery and jugular vein since the metal shield does not extend far enough around the throat on both sides to protect such vital throat areas.

The neck and collarbone protector described in U.S. Pat. No. 4,449,251 comprises a combined bib and upstanding collar to protect the clavicles and throat of the wearer respectively. Each of the bib and collar includes protective foam padding and rigid armour members which overlie the clavicles and vulnerable front and side parts of the throat, the armour members being molded from rigid plastics material or stamped from metal sheet. Although the collar of such a protector may offer adequate protection against throat lacerations, the whole unit is of complex structure and thus costly to manufacture. Also, since the armour members are rigid, the collar is not sufficiently flexible to permit free movement of the head, therefore impiding the ability of the sport player to perform efficiently.

SUMMARY OF THE INVENTION

It is therefore an object of this invention invention to overcome the above drawbacks and to provide a lightweight, flexible neck protector which is of simple and economical construction, yet efficiently protecting a wearer's throat area against lacerations.

In accordance with the present invention, there is provided a neck protector for protecting a wearer's throat area against lacerations, comprising an elongated, substantially flat armour member adapted to be positioned about the neck of a wearer and shaped to at least cover vital areas of the wearer's throat, the armour member being made of a flexible slash resistant material having a slash-resistance of at least about 120 lbs, and means fixed to the armour member for enabling the member to retain a protective shape over the vital throat areas.

As an example of a suitable slash-resistant material meeting the above requirements, use can be made of a seamless-knitted fabric material sold under the trade mark WHIZARD by Bettcher Industries, Inc. Vermilion, Ohio, U.S.A. This material is constructed of threads each having a flexible metallic core encassed in a high-strength textile fiber wrapping and, depending upon the type of metallic core and textile fiber wrapping, it has a slash-resistant of about 120 lbs or over. For instance, where the metallic core is made of stainless steel and the high-strength textile fiber wrapping comprises a blend of aramid and nylon fibers, the fabric material has a slash-resistance of about 120 lbs whereas, in the case of a high-strength polyester fiber wrapping, a slash-resistance of about 130 lbs is obtained. The tests for determining the slash-resistance values of fabrics are performed utilizing an Instron Compression Tester with sharpened tungsten carbide butcher's (boners) knife and the values given above represent averages for parallel, perpendicular and diagonal slashes. By way of comparison, leather (1-ply, 60 oz./yd.$^2$ cowhide) has a slash-resistance of only 40 lbs.

In other words, the flexible slash-resistant material used in accordance with the invention is extremely resistant to cutting and, in fact, is practically uncutable by sharp-edged objects such as hockey stick blades and skate blades. The material is also lightweight and soft to one's touch. However, due to its flexibility, it has a strong tendency to curl up and therefore it is necessary to attach to the material a means for preventing this curling, thereby enabling the armour member to retain a protective shape over the vital throat areas of the wearer. Such a shape-retaining means may comprise for example a plurality of stays sewn to the slash-resistant fabric material, but preferably comprises a fabric backing secured to the armour member along a peripheral edge thereof. A particularly preferred fabric backing comprises a foam padding laminated on either side by a textile material, e.g. cotton, which provides both comfort and a cushioning effect in respect to blows from a hockey stick or puck.

Preferably, the armour member is formed along an upper longitudinal edge thereof with a centrally located chin accomodating recess and a convex enlargement on either side of the recess. Thus, the armour member substantially covers the vital throat areas while being prevented from rotating around the wearer's neck.

The armour member with its fabric backing can be worn directly on the body or can be encassed in an outer sleeve of fabric material conforming to the shape of the armour member, the sleeve being provided at the end portions thereof with releasable fastener means for releasably holding the sleeve and the encassed armour member around the wearer's neck. Such an outer sleeve provides comfort, aesthetic effect and, if desired, different colors to match the colors of the team uniforms.

Preferably, the sleeve is formed with a centrally located rear pocket opening for removably inserting the armour member inside the sleeve. It is advantageously provided with a depending bib of fabric material so as to assist in maintaining the sleeve with the encassed armour member positioned in place around the wearer's neck. The bib may be formed of a 2-ply textile material with a liner therebetween serving to retain the shape of the bib, such as a quilted liner, foam padding or PELLON (trade mark; a non-woven fabric). BRIEF DESCRIPTION OF THE DRAWINGS Further features and advantages of the invention will become more readily apparent from the following description of a preferred embodiment thereof as illustrated by way of example in the accompanying drawings, in which:

DESCRIPTION OF PREFERRED EMBODIMENTS

Figure 1:
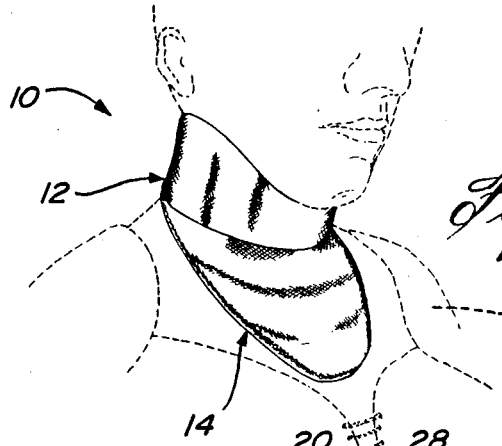
FIG. 1 is a perspective view of a neck protector according to the invention, shown installed around the neck of a wearer.

The sports neck protector illustrated in the drawings and generally designated by reference numeral 10 is seen to comprise a collar 12 and a depending bib 14, the collar 12 being adapted to be positioned about the neck of a wearer 16 represented in broken lines in FIG. 1.

Figure 2:
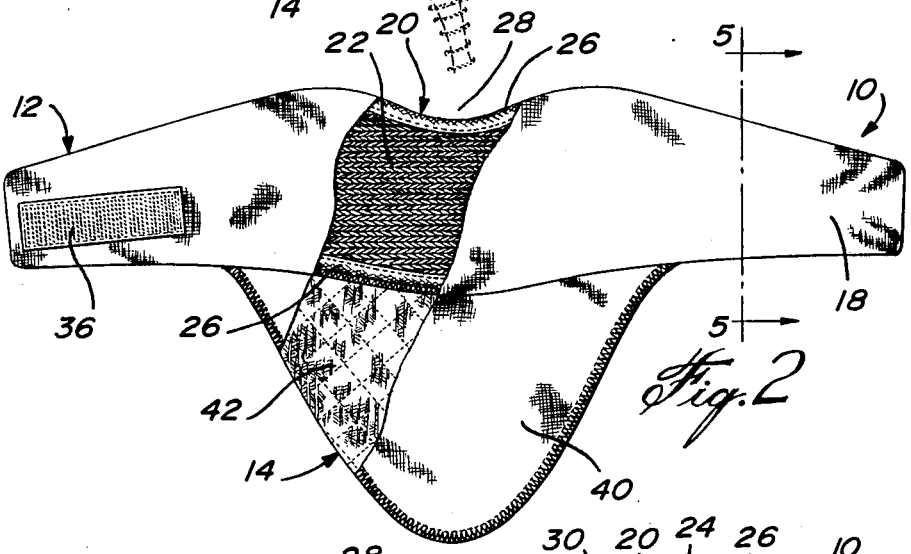
FIG. 2 is a front elevation view of the neck protector illustrated in FIG. 1, partly cut away to show hidden features.
Figure 3:
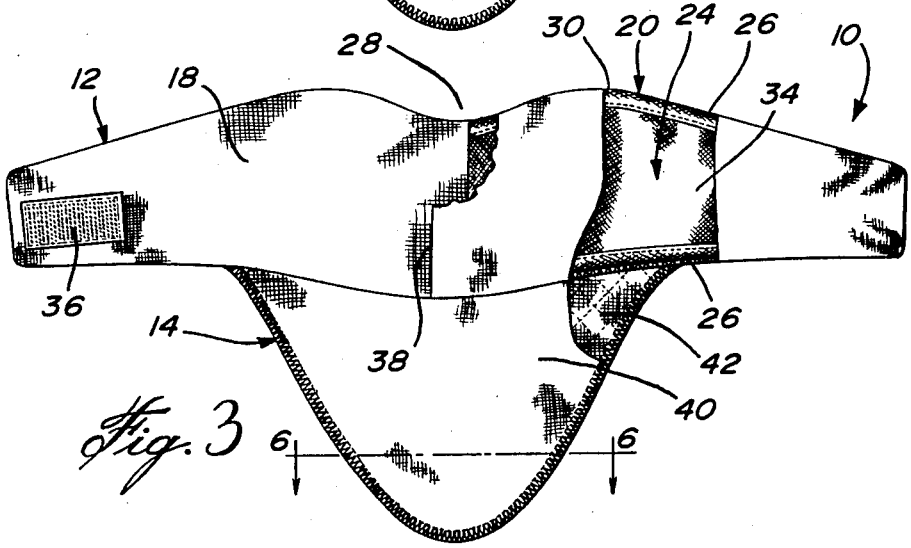
FIG. 3 is a rear elevation view of the neck protector also partly cut away.
Figure 4:
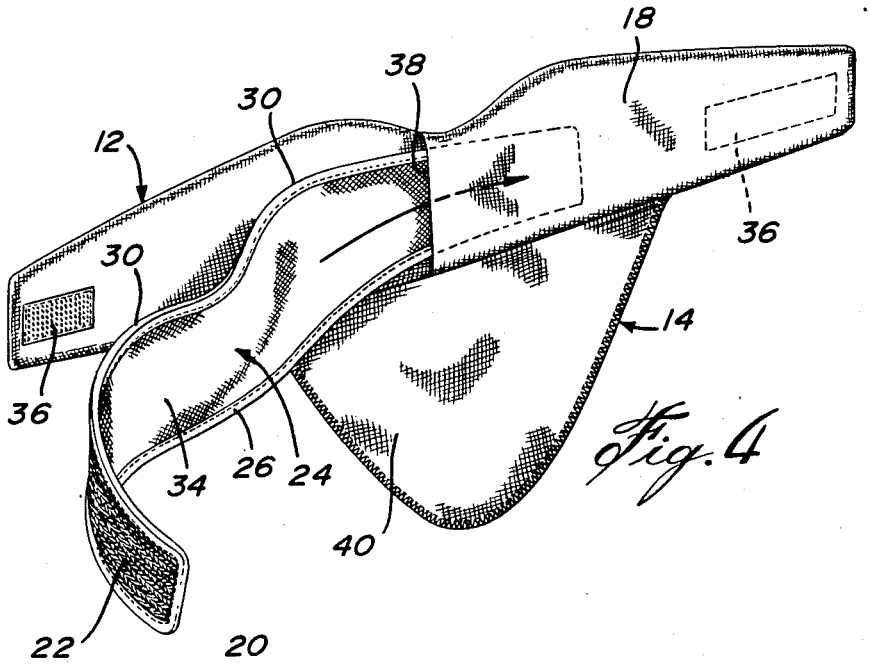
FIG. 4 is another perspective view but from the rear, showing how the armour member with its fabric backing may be inserted in the outer sleeve.
Figure 5:
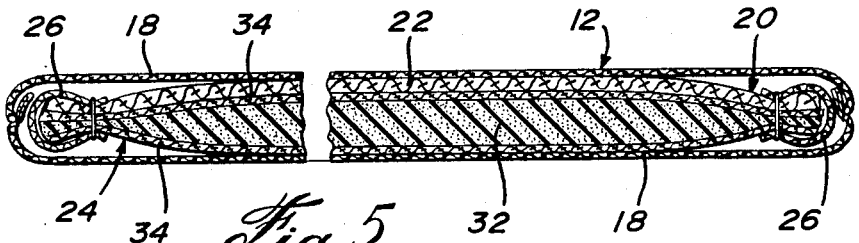
FIG. 5 is a sectional view taken along line 5—5 of FIG. 2.
Figure 6:
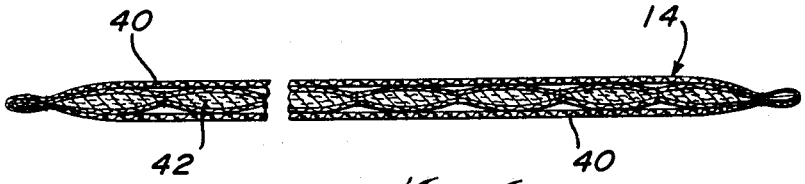
FIG. 6 is a sectional view taken along line 6—6 of FIG. 3.

As shown in FIGS. 2–4, the collar 12 includes a sleeve 18 of fabric material encassing a removable armoured insert 20 which comprises an elongated, substantially flat armour member 22 and a fabric backing 24 secured to the armour member along its peripheral edge by means of a stitched fabric binding tape 26. The armour member 22 is made of a seamless-knitted fabric material sold under the trade mark WHIZARD, which has a slash-resistance of at least about 120 lbs and is practically uncutable by sharp-edged objects such as hockey stick blades and skate blades. The member 12 is formed along its upper longitudinal edge with a centrally located chin accomodating recess 28 and a convex enlargement 30 on either side of the recess 28, thereby substantially covering the vital throat areas while being prevented from rotating around the wearer's neck. As best shown in FIG. 5, the fabric backing 24 comprises a foam padding 32 laminated on either side by a ply of textile material 34, the binding tape 26 being stitched to both the armour member 22 and foam padding 32. The armoured insert 20 thus offers maximum protection of the vital throat areas and yet, due to its construction, is sufficiently flexible to permit free movement of the head.

The sleeve 18 which conforms to the shape of the armoured insert 20 is provided adjacent the ends thereof with interlocking hook and loop fastenings 36 sold under the trade mark VELCRO, for releasably holding the sleeve 18 and armoured insert 20 around the wearer's neck. It is formed with a centrally located rear pocket opening 38 for enabling the insert 20 to be encassed in or removed from the sleeve 18, as best shown in FIG. 4.

The bib 14 which serves to assist in maintaining the sleeve 18 and armoured insert 20 positioned in place around the wearer's neck is formed of a 2-ply textile material 40 with a quilted liner 42 therebetween. The purpose of the liner 42 is to enable the bib to retain its shape, thus preventing the latter from being dislodged from underneath the wearer's clothing.

As it is apparent, the sports neck protector 10 is of simple and economical construction, yet efficiently protects the wearer's vital throat areas against lacerations and dangerous blows. It is not only very comfortable to wear but also sufficiently flexible to permit free movement of the head, thus unimpiding the ability of the sport player to perform efficiently.

We claim:

1. A neck protector for protecting a wearer's throat area against lacerations, comprising an elongated, substantially flat armour member adapted to be positioned about the neck of a wearer and shaped to at least cover vital areas of the wearer's throat, said armour member being made of a flexible slash-resistant material having a slash-resistance of at least about 120 lbs, and means fixed to said armour member for enabling said member to retain a protective shape over said vital throat areas.

2. A neck protector as claimed in claim 1, wherein said slash-resistant material is a seamless-knitted fabric material constructed of threads each having a flexible metallic core encassed in a high-strength textile fiber wrapping.

3. A neck protector as claimed in claim 2, wherein said metallic core is made of stainless steel and said high-strength textile fiber wrapping comprises a blend of aramid and nylon fibers.

4. A neck protector as claimed in claim 3, wherein said fabric material has a slash-resistance of about 120 lbs.

5. A neck protector as claimed in claim 1, wherein said shape-retaining means comprises a fabric backing secured to said armour member along a peripheral edge thereof.

6. A neck protector as claimed in claim 5, wherein said fabric backing comprises a foam padding laminated on either side by a textile material.

7. A neck protector as claimed in claim 1, wherein said armour member is formed along an upper longitudinal edge thereof with a centrally located chin accomodating recess and convex enlargement on either side of said recess, whereby said armour member substantially covers said vital throat areas while being prevented from rotating around the wearer's neck.

8. A neck protector as claimed in claim 7, further including an outer sleeve of fabric material encasing said armour member and conforming in shape thereto, said sleeve being provided at end portions thereof with releasable fastener means for releasably holding said sleeve and said encassed armour member the wearer's neck.

9. A neck protector as claimed in claim 8, wherein said sleeve is formed with a centrally located rear pocket opening for removably inserting said armour member inside said sleeve.

10. A neck protector as claimed in claim 8, wherein said sleeve is provided with a depending bib of fabric material whereby to assist in maintaining said sleeve and said encassed armour member positioned in place around the wearer's neck.

11. A neck protector as claimed in claim 10, wherein said bib is formed of a 2-ply textile material with a form-retaining liner therebetween.

12. A neck protector as claimed in claim 8, wherein said releasable fastener means comprise interlocking hook and loop fastenings.

* * * * *